US007776255B1

(12) United States Patent
Wedding et al.

(10) Patent No.: US 7,776,255 B1
(45) Date of Patent: Aug. 17, 2010

(54) HOLLOW SHELL AND METHOD OF MANUFACTURE

(75) Inventors: Carol Ann Wedding, Toledo, OH (US); Thomas J. Pavliscak, Palos Verdes Estates, CA (US); Oliver M. Strbik, III, Holland, OH (US); Joe K. Cochran, Jr., Marietta, GA (US)

(73) Assignee: Imaging Systems Technology, Toledo, OH (US)

( * ) Notice: Subject to any disclaimer, the term of this patent is extended or adjusted under 35 U.S.C. 154(b) by 0 days.

(21) Appl. No.: 12/103,687

(22) Filed: Apr. 15, 2008

Related U.S. Application Data

(60) Provisional application No. 60/911,961, filed on Apr. 16, 2007.

(51) Int. Cl.
*B22F 3/00* (2006.01)

(52) U.S. Cl. ..... 419/5; 419/29; 419/36; 419/37

(58) Field of Classification Search ..... 419/5, 419/36, 37, 29
See application file for complete search history.

(56) References Cited

U.S. PATENT DOCUMENTS

| | | | | | |
|---|---|---|---|---|---|
| 3,528,809 | A * | 9/1970 | Farnand et al. | ..... | 264/635 |
| 4,162,914 | A * | 7/1979 | Cremer | ..... | 428/547 |
| 4,775,598 | A * | 10/1988 | Jaeckel | ..... | 428/550 |
| 4,917,857 | A * | 4/1990 | Jaeckel et al. | ..... | 419/9 |
| 6,582,651 | B1 * | 6/2003 | Cochran et al. | ..... | 419/5 |

* cited by examiner

*Primary Examiner*—Roy King
*Assistant Examiner*—Ngoclan T Mai
(74) *Attorney, Agent, or Firm*—Donald K. Wedding

(57) ABSTRACT

Hollow metal and/or metal alloy articles are fabricated by the reduction of metal containing compounds, particularly non-metallic metal compounds.

15 Claims, 2 Drawing Sheets

HOLLOW SHELL AND METHOD OF MANUFACTURE

RELATED APPLICATION

This application claims priority under 35 U.S.C. 119(e) to U.S. Provisional Patent Application Ser. No. 60/911,961, filed Apr. 16, 2007.

INTRODUCTION

This invention relates to high strength, lightweight shells, and methods of manufacturing such shells. More particularly, this invention relates to the manufacture of strong, lightweight metallic hollow shells and the use of such shells as proppants in hydraulic fracturing. This invention is used to prepare hollow metallic shells that are typically spherical. However, other suitable geometric shapes are contemplated. Although the invention is described with reference to proppants, the hollow shells of this invention have utility in other applications including but not limited to structural applications, fillers, and heat sinks.

PROPPANT BACKGROUND

Hydraulic fracturing is a means of creating fractures emanating from the well bore in a producing formation to provide increased flow channels for production. A viscous fluid containing a proppant such as sand is injected under high pressure until the desired fracturing is achieved. The pressure is then released allowing the fluid to return to the well. The proppant, however, remains in the fractures preventing them from closing.

Proppants are particulates that resist high temperature, pressure, and closure stresses present in the formation. If proppants fail to withstand the closure stresses of the formation, they disintegrate to produce fines or fragments, which reduce the permeability of the propped fracture.

In the prior art, proppants include silica sand, glass beads, walnut shells, and aluminum microspheres. Based on a balance of cost and compressive strength, silica sand, commonly known as frac-sand, is a widely used proppant in fracturing. However, its use is limited to a depth with closure stresses of about 41 MPa (Mega Pascal). One MPa equals one million Pascals. One Pascal equals the force of one Newton per square meter area. Beyond this depth resin-coated and ceramic proppants are used. Resin-coated and ceramic proppants are generally limited to closure stresses of about 55 MPa and 83 MPa, respectively.

According to a study for the United States Department of Energy, published in April 1982 (Cutler and Jones, 'Lightweight Proppants for Deep Gas Well Stimulation' DOE/BC/10038-22), ideal proppants for hydraulic fracturing should have a specific gravity less than 2.0, be able to withstand closure stresses of 138 MPa, be chemically inert in brine at temperatures up to 200° C., have perfect sphericity, cost the same as sand on a volume basis, and have a narrow proppant size distribution. The report concludes that such a proppant is not likely to be forthcoming in the foreseeable future.

PROPPANT PRIOR ART

Proppants are known in the prior art and include U.S. Pat. Nos. 4,493,875 (Beck et al.), 5,030,603 (Rumpf et al.), 5,120,455 (Lunghofer), 6,364,018 (Brannon et al.), 6,753,299 (Lunghofer et al.), 7,160,844 (Urbanek), and 7,213,651 (Brannin et al.), all incorporated herein by reference.

BACKGROUND OF THE INVENTION

This invention relates to the fabrication of hollow metal and/or metal alloy articles from a metal containing compound such as a metal oxide. In one embodiment, hollow metallic shells are produced by the direct reduction of non-metallic metal precursors The process of producing metals by direct reduction of non-metallic metal precursors is known in the art. Non-metallic metal precursors comprise metal bearing ores or metal oxides in powder form. The direct reduction (DR) process produces metal directly from metal-bearing ores or oxides by removing the associated oxygen or other anions at a temperature below the melting temperature of any of the materials involved in the process. Iron, for example, has been produced in this manner prior to the invention of the blast furnace, in which iron is melted and reduced with carbon and withdrawn as liquid, molten metal. Direct-reduced iron (DRI) is normally produced in the form of lumps or agglomerates due to extremely high volume shrinkage up to 55% and weight loss up to 30%. Whether the product maintains its original shape or its structural integrity has not been a concern. DRI is solely used as substitution for scrap steel in order to boost the production rate of other steel-making processes in either a blast furnace or an electric arc furnace. Methods for producing metals by direct reduction are disclosed in the prior art including: U.S. Pat. Nos. 7,135,141 (Han et al.), 7,001,570 (Niimi et al.), 6,921,510 (Ott et al.), 6,737,017 (Woodfield et al.), 6,582,651 (Cochran et al.), and 4,017,290 (Budrick et al.), all incorporated herein by reference.

Direct reduction of a metal oxide requires energy in the presence of suitable reducing agents. Common reductants, for iron include, but are not limited to, hydrogen, carbon monoxide, methane, coal gas, fuel oils, coal, coke, etc. For hydrogen, the reducing agent reacts with oxygen and forms water molecules, which are then removed from the system. It is a well known that the reaction rate will increase as the concentration of reactants increases and decrease as the concentration of reaction products increases (Le Chatelier's Principle). The reaction rate is a function of the available concentration of reactants, the metal oxide, reducing agent, the concentration of reaction products (water vapor) and temperature.

Metals can be produced from non-metallic metal precursor materials such as metal hydrides. A metal hydride such as titanium hydride can be converted to metal by heating the metal hydride to a temperature sufficient to decompose the hydride. For titanium hydride the decomposition temperature is about 600° C. Above the decomposition temperature, the titanium hydride separates into titanium and hydrogen gas. At higher temperatures, the titanium powder can be consolidated to a dense metal by solid state sintering. This process also applies to hydrides of vanadium and zirconium.

The present invention discloses methods and processes for the producing hollow metal and metal alloy shells of varied geometrical shape that possess high strength and are suitable for use as proppants. Fabricating non-metallic articles with a specific geometry from non-metallic metal precursors is known in the art. Methods of shape fabrication of non-metallic articles include: dry pressing, slip casting, pressure casting, centrifugal casting, gel coating, slurry casting, and extrusion.

The most common method used to consolidate powders as starting materials into a useful shape is "dry pressing", which is a traditional forming process. Although the name includes "dry" as a modifier, the starting materials usually contain a few percent of moisture by weight to differentiate it from wet or semi-wet pressing, such as the "stiff mud" process. The basic dry pressing process involves applying the pressure uniaxially. If pressure is applied from all directions, or isostatically, then the process is called "isostatic pressing". Property requirements and manufacturing economics determine whether the pressure is to be applied uniaxially, biaxially or isostatically. Uniaxial pressure fabrication is a very common forming process. It is used to form tiles and other flat shapes, as well as simple shapes such as disks or cylinders. The cross-sections that can be formed are simple geometrically, although the pressed shapes can be machined into more complex geometries. A large number of holes can be made in the pressed parts with the aid of inserts. The height is usually limited relative to the lateral dimension or diameter. Pressing of floor tile is one example of a dry pressing process that has been highly automated.

Conventional slip casting is a process for forming articles with a suspension of ceramic powders. Water is generally used as the liquid medium, although some non-aqueous solvents have been used.

Pressure slip casting is the same process as slip casting, however, pressure is applied to the slip in the mold. Pressure casting is being applied in the sanitary ware industry and has produced a number of advantages. Casting times are significantly cut and parts can be easily unmolded. When an air purging system is used, molds do not require a drying cycle between casting cycles and thus can be returned to service immediately. Mold life is much longer than conventional plaster molds, and fewer defects occur because of mold wear. Moreover, product quality is more consistent and the cast part has less moisture to be removed. This eases drying requirements and cuts drying defects and losses. Parts with variable thickness are easier to mold. One person can operate two or more casting machines, including fettling of parts, and the process can be run two or more shifts per day. The net result is greater throughput, lower labor costs, and lower overall production costs.

Centrifugal slip casting is another means of increasing pressure at the casting face, but with lower pressure than in the pressure casting process.

Gel casting is a recently developed technique for water and is currently being used to form complex shape ceramic rotors for automotive turbochargers. In the gel casting process, a slurry, consisting of a powdered precursor, a polymer precursor, usually a monomer, and water. The slurry is poured into a mold and the monomer is polymerized to form a gel. This polymerization process locks the powdered precursor into a polymer matrix. The water is removed and the green part is heated to remove the polymer. There are multiple casting slip properties that are desirable for an optimum process. These properties include: low viscosity, i.e., high flow rates, to allow all parts of the mold to be easily filled and to prevent trapping of air bubbles; high specific gravity to shorten casting time, increases green density, lowers drying shrinkage, and lowers the amount of water that must be processed; good casting rate; easy mold release; adequate draining behavior from the mold at the end of the cast; and sufficient green strength in the cast layer to allow ease of handling.

Extrusion is an effective and efficient method of forming material continuously or semi-continuously using somewhat simple equipment. In the extrusion process, materials that can be melted, softened, or mixed into a plastic state are forced through a die to obtain the desired shape. Extrusion has been used for many years in the clay/porcelain industries. The advantages of extrusion as a forming and consolidation process have been recognized and utilized by manufacturers of nearly all materials. More recently, it has been used with fine, technical ceramics such as silicon carbide, silicon nitride, and oxide materials. Shaping capability has also expanded greatly, from simple rods and tubes to complex profiles, sheets/films, and honeycombs.

Extrusion has limitations and cannot be used to make all products. It is best suited to fabricate shapes that are of a constant cross section and can be linearly formed. Typical products formed by extrusion are: tubes or pipes, with either open or closed ends; profiles of numerous shapes; rods; honeycombs; plates (solid, hollow, or ribbed); and films.

DETAILED DESCRIPTION OF THE DRAWINGS AND SPECIFIC EMBODIMENTS

This invention relates to fabricating hollow metal or metal alloy shells comprising the following processes: preparation of metal oxide raw materials; preparation of sacrificial core raw materials; fabrication of a sacrificial core; preparation of a slurry of non-metallic metal precursor materials; coating the sacrificial core with non-metallic metal precursor materials slurry; burn-out of the sacrificial core; conversion of non-metallic metal precursor materials into metals; sintering the metals to near full density; and optional property enhancing, post reduction/sintering/heat treating.

In accordance with this invention, there is provided a method and process for producing hollow alloy core shells which comprises coating non-metallic metal precursor materials onto a sacrificial core. The coating of non-metallic metal precursor materials may be comprised of a mixture of different micro-particle and/or nano-particle metal oxides, metal hydrides, nitrides, or other suitable non-metallic precursors. Typical particle sizes range from about 0.1 to 5 microns in average diameter. Other particle sizes are contemplated based on shell thickness, processing time, sintering temperature, and material selection.

The size and shape of the produced hollow metal alloy shells is defined by the size and shape of the sacrificial core and the thickness of the coating applied. The process of reduction and sintering causes the alloy shell to shrink to the finished size of the hollow metal alloy shell. These methods and processes provide for the production of hollow metal or metal alloy shells from about 200 microns to 5,000 microns in diameter. Sizes outside this range may be produced.

Process descriptions or blocks in the flow chart should be understood as representative modules, segments, or portions of the process, which include one or more executable instructions for the implementation of specific steps in the process. Alternate implementations are included within the scope of the preferred embodiment of the invention, as understood by those skilled in the art.

Figure 1:
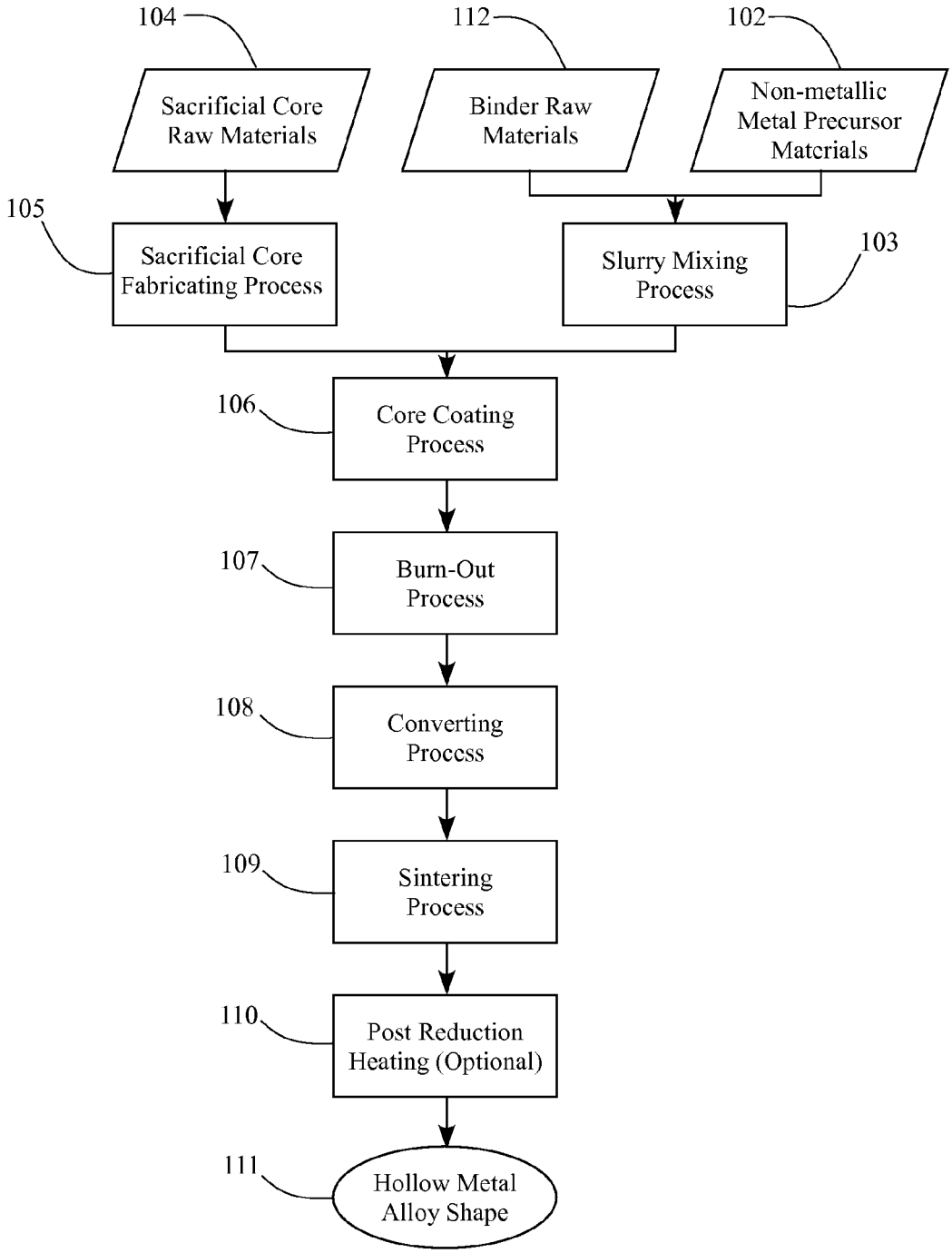
FIG. 1 is a method and process flow chart for producing hollow metal or metal alloy shells.

FIG. 1 shows the manufacturing process for producing hollow metal or metal alloy shells. The manufacturing process is flexible and adaptive to meet a wide range of hollow metal alloy shell product requirements including the customized low cost production of metal alloy shell size, shape, density, ductility, deformability, composition, material properties, electro-conductivity, and the application of beneficial coatings.

The sacrificial core fabrication process 105 provides a method of customizing the size and shape of the hollow metal shell. In this process 105 suitable core raw materials 104 are formed into a sacrificial core. Suitable core raw materials 104 are those that are generally composed of organic compounds, that completely pyrolize at a low temperature, and do not react detrimentally with the shell materials during pyrolization. Suitable core materials include polyethylene and polystyrene. Suitable methods for shaping the sacrificial core include prilling, pressing, or steam expansion. A prilling process produces substantially round cores the diameter of which can be controlled through selection of process parameters. Other methods of core fabrication are also contemplated.

This invention provides a method of customizing material properties for strength, ductility, deformability, electro-conductivity, chemical resistance, and cost of the hollow metal alloy shell. In addition to providing customization of size and shape, the contemplated sacrificial core fabrication process has sufficient control to allow the fabrication of sacrificial cores that are highly uniform in size, weight, and shape with a smooth surface finish. Because the sacrificial core acts as a substrate for the slurry, a highly uniform preform will allow for a highly uniform defect free coating later in the process, which will lead to high-quality, high-yield hollow metal alloy shells. Additionally, the forming process should produce cores of sufficient density that they may be easily coated, but will still burn out completely. Cores produced in process 105 have a nominal density of about 0.03 g/cm$^3$ to 1.5 g/cm$^3$, a nominal melting temperature of about 100° C. to 150° C. and a nominal diameter of about 200 microns to 5,000 microns.

The slurry mixing process 103 comprises the combining of binder materials 112 and precursor materials 102. Non-metallic metal precursor 102 materials are selected in the appropriate proportion to produce the desired metal alloy after conversion and sintering. The slurry process supports a wide variety of materials such as hematite $Fe_2O_3$ and other oxides, hydroxides, carbonates, nitrates, carbides, and nitrides of iron, cobalt, nickel, copper, molybdenum, chromium, niobium, manganese, and other metals. Other non-metallic metal precursors, include, but are not limited to, hydrides, particularly titanium, vanadium, and zirconium hydrides.

The organic binders 112 comprise any suitable inorganic or organic materials. Suitable organic materials include polymers selected from the group consisting of polyethylene, polyacrylate, polyvinyl acetate, polyvinyl alcohol, polyvinyl chloride, polybutyrate, polyamide, cellulose ester, phenol resin, amino resin, and epoxy resins. Particularly suitable binders consist of polyacrylates and cellulose esters. Other materials include alginates, gums, vinyls (polyvinyl alcohol), starches, acrylics, acrylamides, dextrins, and cellulose derivatives such as methylcellulose, hydroxyethylcellulose, and hydroxypropoyl methylcellulose. The binder is dispersed in an aqueous vehicle in a suitable quantity, typically about 0.5% to 15% by weight binder. The vehicle may contain one or more organic solvents. The function of the vehicle is to carry a dispersion, suspension, or solution of the binder for incorporation with particulates of the precursor material to form the slurry. The slurry composition applied to the core is about 0.5% to 15% by weight binder and about 99.5% to 85% by weight particulates of the precursor such as metal or metal oxides. Surfactants may also be added as required.

Alternate slurry compositions that are compatible with this process include fine particle ceramics, metals, or metal oxides mixed with organic binders and surfactants. Metallic powder particles are selected from metals of the group Al, B, C, Co, Cr, Cu, Fe, Mn, Mo, Nb, Ni, P, S, Si, Ta, Ti, W, Zr, and noble metals for example, gold, platinum, silver, and iridium. Alternative mixtures of components from one or both of the stated groups of materials may be used. For production of hollow metal or metal alloy shells, metal powders and corresponding metal oxide powders or combinations thereof may be used. Particularly elements which form easily reducible oxides, such as Fe, Ni, Co, Cu, noble metals, W and Mo, may be used in the form of the oxides and may be reduced, at least in part, to elemental metal during the sintering process. The powder particles employed consist of ceramic and/or metallic materials and have a particle size of about 0.1 to 5 microns, typically about 0.5 to 1.5 microns. The selected particle size will depend on the purpose for which the hollow shells are to be used. Finer particles will sinter to impervious at lower temperatures, and will exhibit greater shrinkage when sintered as compared to larger particle slurries.

The apparent density of a hollow metal alloy shell, composed of a given metal or metal alloy, is controlled in the core coating process 106. In this process, the selected metal oxide slurry is applied to the sacrificial cores. Suitable coating methods include, but are not limited to, spraying, pan coating, and fluidized beds. In this process the thickness of the shell may be controlled to customize the density. The density of the shell also affects the strength and the cost of the hollow metal alloy shell. By choosing the preform coating deposition time, so as to deposit the desired wall thickness of about 20 μm to 800 μm as part of the standard manufacturing coating process 106, hollow metal alloy shell wall thickness may be produced over a wide range as part of the flexible manufacturing process. Wall thickness directly impacts hollow metal alloy shell density and strength. Changes in the wall thickness provide for customizing both hollow metal or metal alloy shell properties. An even coat is achieved by selecting a slurry composition that wets evenly over the preform, and dries quickly. Many thin coats will improve the uniformity, density, and manufacturing yield of the hollow metal shells. The duration of the core coating process will depend on the coating thickness desired and the temperature of the fluidizing gas, which is at a temperature between about 70° C. and 120° C. The application and drying of the coating are generally completed within a time from 1 to 3 hours.

The burn-out process 107 provides a method for heating and removing the sacrificial core and other organics by pyrolizing, decomposition, or other such mechanisms, so as to leave a hollow metal oxide shell in a bisque state. The burn-out process may occur in an inert, reducing, or oxidizing atmosphere. The choice of atmosphere is based, in part, on the organic material present in the core and binder and the mechanism required for removal. A sufficient burn out temperature is usually below about 900° C.

In the converting process 108, the non-metallic metal precursor is converted to metal by heating in an appropriate atmosphere. For example, metal oxides can be reduced in a hydrogen atmosphere. The decomposition of metal hydrides in a mixture of metal oxides will provide for an additional hydrogen reducing agent to assist in the direct conversion of the metal oxide materials.

During the sintering process 109, the metals are heated into strong, contiguous, and impervious hollow metal alloys shells. Sintering may also take place in a reducing or inert atmosphere to prevent oxidation of the metals.

Optional post sintering heat treating process 110 including quenching and annealing may be provided to optimize the material properties including hardness, tensile strength, yield strength, and ductility.

Examples of metal alloy materials include maraging steel (200), maraging steel (350), 4140 low alloy steel, 15-5 PH stainless steel are shown in Tables I, II, III, and IV, below.

TABLE I

| AISI Grade 18Ni(200) Maraging Steel Aged | |
|---|---|
| Component | Wt % |
| Al | .1 |
| B | .003 |
| C | <=.03 |
| Co | 8.5 |
| Fe | 69 |
| Mn | .1 |
| Mo | 3.25 |
| Ni | 18.5 |
| P | <=.01 |
| S | <=.01 |
| Si | <=.01 |
| Ti | .2 |
| Zr | .01 |

TABLE II

| AISI Grade 18Ni(350) Maraging Steel Aged | |
|---|---|
| Component | Wt % |
| Al | .1 |
| B | .003 |
| C | <=.03 |
| Co | 12 |
| Fe | 63 |
| Mn | .1 |
| Mo | 4.8 |
| Ni | 18.5 |
| P | <=.01 |
| S | <=.01 |
| Si | <=.01 |
| Ti | 1.4 |
| Zr | .01 |

TABLE III

| AISI 4140H Steel, Low Alloy Steel, heat treated, tempered | |
|---|---|
| Component | Wt % |
| C | .37-.44 |
| Cr | .75-1.2 |
| Fe | >=96.585 |
| Mn | .65-1.1 |
| Mo | .15-3 |
| P | <=.035 |
| S | <=.04 |
| Si | <=.15-.3 |

TABLE IV

| AK Steel Precipitation Hardening Stainless Steel 15-5 PH | |
|---|---|
| Component | Wt % |
| C | <=.07 |
| Cr | 14-15.5 |
| Cu | 2.5-4.5 |
| Fe | 71.91-79.85 |
| Mn | <=1 |
| Nb + Ta | .15-.45 |
| Ni | 3.5-5.5 |
| P | <=.04 |

TABLE IV-continued

| AK Steel Precipitation Hardening Stainless Steel 15-5 PH | |
|---|---|
| Component | Wt % |
| S | <=.03 |
| Si | <=1 |

For example, a mixture of the appropriate ratios of metal oxide and metal hydride materials that may be combined to produce maraging steel (350), when converted in a hydrogen atmosphere, include: $Fe_3O_4$, NiO, $Co_3O_4$, $TiH_2$, and Mo.

Both the atmosphere and the heating schedule are controlled during the reduction and sintering process. For example, from the starting material hematite ($Fe_2O_3$) to iron (Fe), the material will experience changes through magnetite ($Fe_3O_4$) and wustite (FeO). The phase transition from hematite to magnetite involves a contraction of 2.2% based on their respective theoretical densities. However in actuality it also involves a temporary expansion of up to 20%, causing a detrimental stretching effect on the article. It is found that the harmful effect of this interim phase change can be alleviated either by the initiation of reduction at about 1000° C. or by a vacuum-assisted conversion from hematite to magnetite at 500° C.

For reduction at temperatures below about 900° C., the body is composed of loosely packed metallic grains that posses weak mechanical strength. This is because the temperature is too low for sintering to take place. It is well known that most chemical reactions, including the reduction of metal oxide at elevated temperatures, the higher the temperature the higher the reaction rate. The higher reaction rate takes place at the expense of higher density gradient from exterior to interior. Some sintering is taking place simultaneously so the body has some strength against rupture or cracking. This is where the geometry comes into play in conjunction with the chemical reaction.

For geometry with obvious weakness, or a large fraction of minimal connecting area, the higher density gradient will cause the exterior surface on the higher density side, to crack. In accordance with the practice of this invention, hollow metal alloy spheres produced in the range of about 200 microns to 5000 microns in diameter with shell thickness of about 20 microns to 500 microns do not have geometry with obvious weakness described above, or a large fraction of minimal connecting area. The practice of this invention produces a shell structure with a thin, uniform thickness. Thus, the hollow metal shell articles produced by the presently disclosed embodiments are more physically robust and less prone to defects and stress concentrations that may produce surface cracks thereby making the shells highly suitable for use as proppants and other structural applications.

A central issue related to the direct reduction process is the reducibility of the material involved. Using hydrogen as the reducing agent, the elements that can be reduced readily at below about 1350° C. are oxides of Fe, Co, Ni, Cu, Mo, Cr, Mn, Nb, etc., as predicted by thermodynamic data. Above about 1350° C., melting, and collapse of the pre-reduction article becomes dominant for a wide range of alloys having the aforementioned elements.

Combinations of oxides have been found to produce a synergistic effect. For example, at the same temperature and furnace conditions where $Cr_2O_3$ cannot be reduced, the mixture of $Fe_2O_3$ and $Cr_2O_3$ has been found to reduce completely. Similar effects have been found for niobium oxide, which cannot be reduced at 1350° C. by itself, but has been found to form $Ni_3Nb$ in a mixture with NiO. However, the net effect is the enabling of reduction of elements that are necessary and useful in a wide range of alloys. This represents the discovery of an unusual effect that is not known to persons skilled in the art of direct reduction.

The post reduction heat treating process 110 provides a method to further improve the properties of the hollow metal alloy shell. Physical strength, ductility, and other properties of many metal alloys such as maraging steel may be improved by heat treatment 110 at much lower temperature, below about 900° C., than that required for sintering.

The ability to introduce an element in its oxide form has a cost advantage. Most oxides of transition elements are colorful and hence have been used for a long history as pigments, colorants, or inorganic dyes. Fine powders of these oxides are readily available as commodity at very low cost. The cost difference between a metal oxide and its metal counterpart, if and when it is available in powder form, is usually better than a 1:10 ratio.

Sieving and other methods of size sorting can be used at various stages of the process. Although this process is described with reference to the reduction of hollow metal alloy shells formed from metal oxides, it is not limited to this embodiment. It can also be applied to other non-alloy metals. Additionally, the process does not require the reduction of oxides to alloys.

Figure 2A:
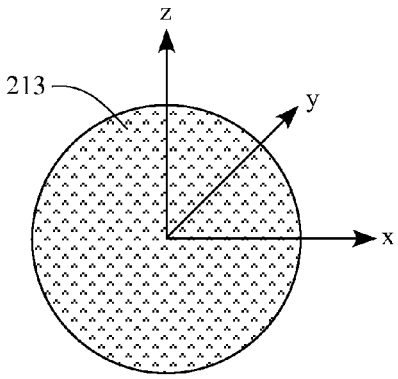
FIG. 2A shows a spherical sacrificial core for hollow metal or metal alloy shell construction.

FIG. 2A shows a sacrificial core 213 for the fabrication of a spherical hollow metal alloy shell.

Figure 2B:
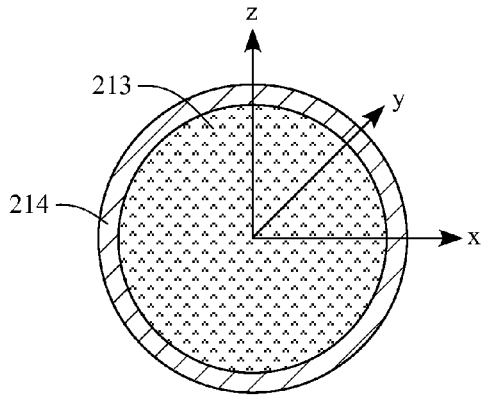
FIG. 2B shows a spherical sacrificial core containing a metal oxide slurry coating the exterior of the core.

FIG. 2B shows a sacrificial core 213 for the fabrication of a spherical hollow metal alloy shell containing a metal oxide slurry exterior coating 214.

Figure 2C:
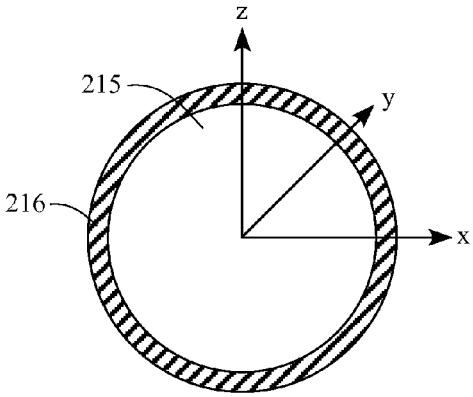
FIG. 2C shows a spherical hollow metal oxide shell after the core has been burned out.

FIG. 2C shows a spherical "bisque state" metal oxide shell 216 prior to reduction and sintering, but after sacrificial core burn out containing hollow center 215.

Figure 2D:
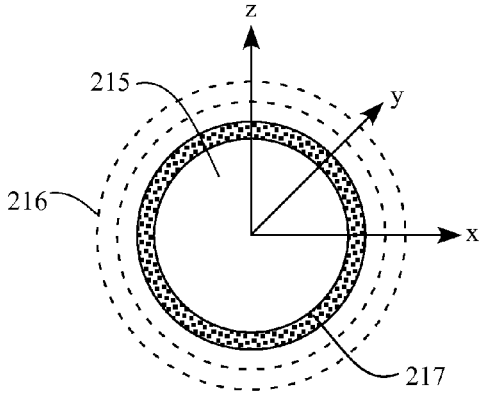
FIG. 2D shows a spherical hollow metal alloy shell.

FIG. 2D shows a fabricated spherical hollow metal alloy shell 217 produced by the direct conversion from metal oxide to a metal alloy. Dotted line 216 is the outline of the shell prior to sintering illustrating the shrinkage that occurs during the sintering process in three dimensions, along the x-, y-, and z-axes during the direct conversion process to form the hollow metal alloy shell of FIG. 2C.

Carbon or Low Alloy Steel

Carbon steel is a combination of two elements, iron and carbon, where other elements are present in quantities too small to affect the properties. The other alloying elements allowed in plain-carbon steel are: manganese (1.65% by weight max), silicon (0.60% by weight max), and copper (0.60% by weight max). Steel with low carbon content has the same properties as iron, soft but easily formed. As carbon content rises, the metal becomes harder and stronger, but less ductile.

Typical compositions of carbon steel include: mild (low carbon) steel: approximately 0.05% to 0.26% by weight carbon content with up to 0.4% by weight manganese content (e.g. AISI 1018 steel) with a tensile strength maximum of about 500 MPa (72,500 PSI); medium carbon steel: approximately 0.29% to 0.54% by weight carbon content with 0.60% to 1.65% by weight manganese content (e.g. AISI 1040 steel); high carbon steel: approximately 0.55% to 0.95% by weight carbon content with 0.30% to 0.90% by weight manganese content; very high carbon steel: approximately 0.96% to 2.1% by weight carbon content, specially processed to produce specific atomic and molecular microstructures.

Carbon steel may be used in the practice of this invention. Carbon may be introduced to the shells in the traditional method as described herein. This can occur during the sintering process 109 or during post processing 110.

Typical steel heat treatments of carbon steel include: spheroidizing, annealing, quenching, martempering, case hardening, and carburizing Case hardening and carburizing only applies to the exterior of the steel part, which is hardened, to create a hard, wear resistant skin, while preserving a tough and ductile interior.

Carburizing and case hardening is a process using steel having a carbon content between 0.1 and 0.3% by weight. In this process, steel is introduced to a carbon rich environment at elevated temperatures for a certain amount of time. Because this is a diffusion controlled process, the longer the steel is held in this environment, the greater the carbon penetration will be and the higher the carbon content. The material is then quenched so that the carbon is locked in the structure. Carburizing and case hardening is implemented by a number of different methods including: packing low carbon steel parts with a carbonaceous material and heating for some time diffuses carbon into the outer layers and quenching/tempering; heating steel parts in a bath of molten barium cyanide or sodium cyanide and quenching/tempering; heating steel parts in a furnace at about 927° C. (1700° F.) containing a partial methane or carbon monoxide atmosphere and quenching/tempering; heating a steel part to about 482° C.-621° C. (900° F.-1150° F.) in an atmosphere of ammonia gas and dissociated ammonia and quench/tempering; heating parts in a bath of sodium cyanide to a temperature in the austenitic phase and then is quenched. This creates a very hard, yet thin case; and a carbonitriding process with a gaseous atmosphere of ammonia and hydrocarbons is used instead of sodium cyanide.

Carbon may also be introduced to the hollow shells during the slurry mixing process 102. In this case carbon will be introduced in the appropriate proportions as part of a molecule, for example, silicon carbide. Other molecules consisting of carbon may also be used.

In low alloy steel, or carbon steel, the amount of carbon must be carefully controlled. Changing the carbon content by more then 0.1% by weight can cause large changes in the strength and ductility. In addition to controlling the amount of carbon that is added to the processes described herein, it is also beneficial to insure that all carbon residue is removed from the cores.

Prevention of Forms from Sintering Together

If forms produced in accordance with this method are in contact with each other they may have a tendency to sinter or melt together during the firing or sintering process. These forms may be separated by various mechanical means after they cool. However forms that are lightweight and/or hollow such as the hollow shapes described in this invention may be damaged during the separation process. In addition to nonmetallic metal precursors described in this invention other fine-featured shapes composed of glass, metal, or ceramics are also prone to sticking together during the firing process.

Sintering or melting together will be avoided with the addition of material between the hollow shapes to keep them separated. Beneficial separation materials are those that sinter or melt at substantially higher temperature then the materials that comprise the hollow body. These separation materials are selected such that they will not substantially interact with the material of the hollow bodies. Ceramic powders can separate hollow metal shapes formed from nonmetallic metal precursors. One such powder includes alumina.

Mechanical agitation can also be used prior during the sintering and firing process or prior to cooling.

SUMMARY

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. A manufacturing process for producing hollow shell proppants composed of a metal or metal alloy comprising:

combining non-metallic metal precursor particles and binder to form a slurry;

coating a sacrificial core of a predetermined shape with the slurry, said core having a density of about 0.03 g/cm$^3$ to 1.5 g/cm$^3$, a melting temperature of about 100° C. to 150° C., and a diameter of about 200 to 5000 microns;

heating the coated core so as to completely pyrolize the core leaving a hollow shell with the predetermined shape of the pyrolized core;

reducing the shell in a reducing atmosphere so as to convert the metal precursor particles into metal particles while substantially maintaining the predetermined shape of the shell;

sintering the hollow shell in a reducing or inert atmosphere into a strong contiguous and impervious metal structure while substantially maintaining the predetermined shape of the shell; and quenching and annealing the metal shell so as to optimize the hardness, tensile strength and ductility.

2. The process of claim 1, wherein the binder is one or more materials selected from cellulose derivative, gum, starch, polyvinyl alcohol, alginate, acrylamide, acrylic, polyethylene, polyacrylate, polyvinyl acetate, polyvinyl chloride, polybutyrate, polyamide, cellulose ester, phenol resin, amino resin and epoxy resins.

3. The process of claim 1, wherein an inorganic binder is added to the slurry.

4. The process of claim 1, wherein the non-metallic metal precursor particles comprise an oxide of iron, cobalt, nickel, copper, molybdenum, chromium, niobium, manganese, and titanium, and/or an hydride of vanadium, zirconium, and titanium.

5. The process of claim 4, wherein iron oxide in the form of hematite is added to the slurry.

6. The process of claim 1, wherein the precursor is one or more non-metallic precursor materials selected from oxides, hydroxides, carbonates, nitrates, carbides, and nitrides of iron, cobalt, nickel, copper, molybdenum, chromium, niobium, manganese, and other metals.

7. The process of claim 1, wherein at least one non-metallic metal precursor selected from titanium, vanadium, and zirconium hydrides is added to the slurry.

8. The process of claim 1, wherein a beneficial quantity of carbide is added to the slurry to allow the formation of a carbon steel.

9. The process of claim 1 wherein the particles have a particle size of about 0.1 to about 5 microns.

10. The process of claim 1, wherein the slurry contains about 0.5% to about 15% by weight binder.

11. The process of claim 1, wherein the slurry contains about 85% to about 99.5% by weight metal and/or non-metallic metal precursors and about 0.5% to about 15% by weight binder.

12. The process of claim 1, wherein the core is selected from polyethylene and polystyrene.

13. The process of claim 1, wherein the core is coated with multiple layers of slurry.

14. The process of claim 1, wherein the core is coated with slurry using a fluidizing bed.

15. The processes of claim 1, wherein the core is spray coated with slurry.

* * * * *